United States Patent [19]

Jacoby

[11] 3,938,115

[45] Feb. 11, 1976

[54] COMBINATION SMOKE AND HEAT DETECTOR ALARM

[75] Inventor: Sidney Jacoby, Philadelphia, Pa.

[73] Assignee: Evergard Fire Alarm Co., Inc., Philadelphia, Pa.

[22] Filed: June 13, 1974

[21] Appl. No.: 478,928

[52] U.S. Cl. ..... 340/237 S; 116/106; 116/137 R

[51] Int. Cl.[2] ..... G08B 17/04; G08B 17/10

[58] Field of Search ..... 340/237 S, 227 R, 227.1, 340/228.5, 229, 404, 405, 406; 116/65, 70, 106, 114 Y, 142 FP, 2, 3, 5, 67 R, 101, 102, 103, 140, 137 R

[56] References Cited

UNITED STATES PATENTS

| | | | |
|---|---|---|---|
| 3,079,886 | 3/1963 | Green, Jr. | 116/106 |
| 3,109,409 | 11/1963 | Demay | 340/229 UX |
| 3,119,368 | 1/1964 | Barnard | 340/229 UX |
| 3,153,226 | 10/1964 | Jensen | 340/229 X |
| 3,223,068 | 12/1965 | Van Winkle | 116/65 |

*Primary Examiner*—John W. Caldwell
*Assistant Examiner*—Daniel Myer
*Attorney, Agent, or Firm*—Weiser, Stapler & Spivak

[57] ABSTRACT

A combination smoke and heat detector alarm including a self-contained stored energy source in the form of a cylinder of compressed gas. A T-fitting connects to the cylinder and feeds separate conduit systems leading to individual sounding devices. A fusible element is interposed in one of the conduit systems to automatically permit transfer of the compressed gas to a first sounding device upon the presence of elevated temperatures. A solenoid operated switch is interposed in the other conduit system to normally prevent the flow of gas. The solenoid is responsive to a smoke detector and is wired to open the solenoid valve upon sensing the presence of a predetermined concentration of smoke.

12 Claims, 1 Drawing Figure

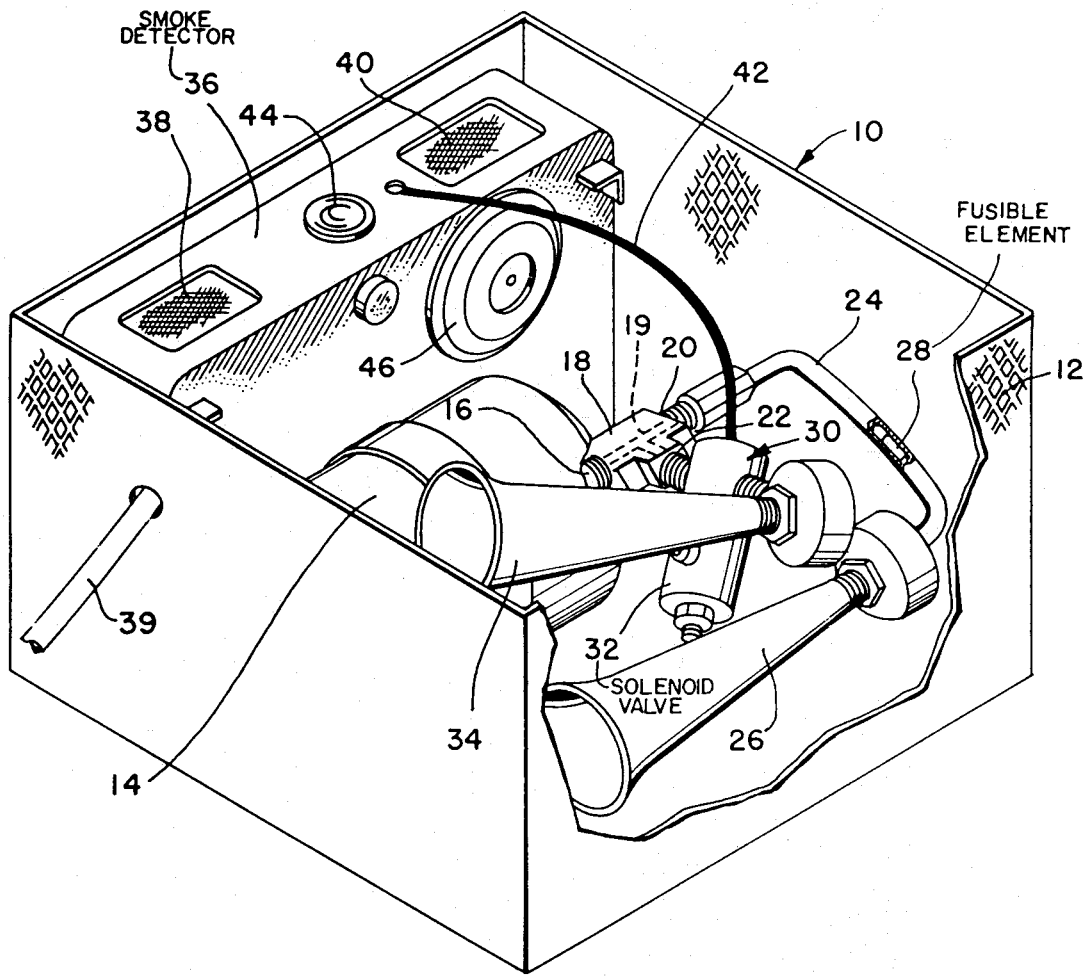
SMOKE DETECTOR
36
38
44
40
42
10
FUSIBLE ELEMENT
24
28
12
19
20
18
22
30
16
46
39
32
SOLENOID VALVE
34
26
14

COMBINATION SMOKE AND HEAT DETECTOR ALARM

BACKGROUND OF THE INVENTION

The present invention relates generally to the field of alarm devices and more particularly, is directed to a combination smoke and heat detector alarm system which is equally responsive to either the presence of heat or to the presence of smoke.

The general premise of the need for protecting occupants of buildings from the danger of fire has long been a building design concept and many types of electrically operated and mechanically operated fire alarm systems have been developed by prior workers in the field. The prior art types of fire alarm systems have varied greatly in reliability, complexity, scope, cost and in the basic protection features afforded by each particular type of design. Additionally, distinctions have traditionally been made between alarm systems suitable for commercial and industrial establishments, and in alarm systems particularly designed for residential use.

Alarm systems such as manual fire alarms, automatic fire alarms, central station connected systems, local supervisory alarm systems, coded and non-coded alarm systems, sprinkler alarm systems and others have been developed for particular applications in specified occupancies. It will be appreciated that the initial cost both in basic equipment price and in the cost of installation varies widely between the different systems available. The safety and reliability features offered by the various systems also are widely divergent. Accordingly, the selection and design of an alarm system when planning a new building or when installing an alarm system in an existing building forms an important design decision dependent upon such factors as the type of occupancy, the type of building construction, the number of persons to be protected, the equipment cost factor, etc.

More recently, tests have been conducted and investigations have been made of actual fires wherein it has been determined that in many instances, the buildings subject to fire become untenable from smoke long before they are untenable due to the elevated temperatures of a fire. Because of this added awareness, much thought has been given recently to personnel protection in buildings. In accordance with these recent studies, safety from smoke considerations now form an important building design parameter. Numerous smoke detection devices have been developed to a degree wherein they are quite reliable and are now in general use. The prior art smoke detection systems have, until now, been employed usually to trigger alarm systems in commercial and apartment buildings upon presence of smoke to thereby warn the building occupants. Because of the added awareness of the dangers inherent in residential fires, many self-contained, single station, relatively inexpensive units have been specifically designed for residential use in an attempt to reduce the number of fatalities resulting from residential fires. Such units have traditionally incorporated a sounding device in the form of a bell or horn and a detecting device which was either responsive to the presence of smoke or to the presence of heat.

There are many reported instances wherein a relatively smoky fire did not generate sufficient heat to actuate a heat-actuated alarm until it was too late to warn the building occupants of the presence of deadly smoke. Other instances have been documented wherein the heat of a fire builds up so quickly as to render a building untenable from heat before sufficient quantities of smoke are generated to activate a usual smoke detection device. Existing smoke detector systems have sometimes failed to properly function when the electrical power required for operation was interrupted by action of the fire itself. Other smoke detector systems have proved deficient to a degree in that the associated alarm device of existing single station units cannot develop sound levels above 93 dBa. Accordingly, a single station unit which incorporates a sounding device capable of emitting alarm signals of greater intensity and which can be actuated both by a heat actuated device and by a smoke actuated device would be most desirable. Heretofore, no such combination unit has been made available for public use.

SUMMARY OF THE INVENTION

This invention relates generally to the field of alarm systems, and more particularly, is directed to a self-contained alarm system that is equally responsive to the presence of smoke and to the presence of heat.

The alarm device of the present invention includes a self-contained energy source which may be in the form of a conventional compressed gas bottle containing an easily compressed gas in liquid form such as "Freon" gas. A fitting connects to the gas cylinder outlet and feeds two separate gas conduit systems, each system of which leads to a separate sounding device, such as a gas operated horn of the type capable of producing an alarm signal of 115 dBa.

Interposed in one of the gas conduit systems is a fusible element which may be in the form of a eutectic alloy which is designed to melt at a predetermined temperature for example, 136° or 174°, depending upon the predetermined conditions of use. Interposed in the second gas conduit system is a conventional solenoid operated valve which is normally closed but which may be moved to its open position upon triggering of a self-contained smoke detection device. The smoke detection device may be of any well-known, approved type such as a photoelectric cell smoke detector or an ionization products of combustion smoke detector. Thus, the combination smoke and heat detector of the present invention is completely self-contained and is equally responsive both to the presence of a predetermined elevated temperature and to the presence of a sufficient concentration of smoke.

It is therefore an object of the present invention to provide an improved combination smoke and heat detector alarm of the type set forth.

It is another object of the present invention to provide a novel combination smoke and heat detector alarm which includes in combination a self-contained source of energy and two sounding devices, one sounding device being responsive to the presence of heat and the second sounding device being responsive to the presence of smoke.

It is another object of the present invention to provide a novel combination smoke and heat detector alarm that is completely self-contained and through a single gas cylinder functions a first horn upon presence of elevated temperatures and a second horn upon presence of a predetermined concentration of smoke.

It is another object of the invention to provide a novel combination smoke and heat detector alarm system which incorporates an independent, mechanically operated heat detector and an independent, electrically operated smoke detector wherein the heat detector is not effected by possible electrical failure of the smoke detector.

It is another object of the present invention to provide a novel combination smoke and heat detector alarm system which is capable of generating an alarm signal in the smoke detector portion of greater intensity than heretofore possible.

It is another object of the present invention to provide a novel combination smoke and heat detector alarm that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a rear perspective view of the invention with the rear cover removed and partially broken away to expose details of interior construction.

DESCRIPTION OF THE PREFERRED EMBODIMENT OF THE INVENTION

Although specific terms are used in the following description for the sake of clarity, these terms are intended to refer only to the particular structure of my invention selected for illustration in the drawings, and are not intended to define or limit the scope of the invention.

Referring now to the drawing, I show in FIG. 1 a combination smoke and heat detector alarm system 10 of the self-contained type wherein the component parts are mounted within an enclosing cabinet 12. The cabinet 12 is preferably fabricated of expanded metal or other material providing a high percentage of open area to thereby permit the ambient air to readily pass therethrough. Thus, the products of combustion (if present) can readily reach the smoke detector installed within the cabinet 12. Similarly, elevated temperatures caused by a fire can directly impinge upon a heat responsive element 28 contained within the cabinet 12.

The source of energy which preferably is in the form of a compressed gas cylinder 14 stores a quantity of liquified compressed gas (not shown) which preferably is liquified "Freon." The gas cylinder 14 is provided with a threaded outlet 16 which is utilized both for cylinder filling purposes prior to installation and to permit the exit of gas therefrom upon the detection of smoke or heat in the manner hereinafter more fully set forth. A threaded fitting 18 of generally T-shaped configuration is threadedly engaged in the outlet 16 and has interior channels 19 communicating with the interior of the gas cylinder 14 to permit gas flow either through the top opening 20 or through the side opening 22 upon actuation of a detecting device.

A first gas conduit system 24 leads from the top opening 20 of the threaded fitting 18 and connects at its other end to a first horn 26 or other suitable sounding device. A fusible element 28 which may be in the form of a eutectic alloy designed to melt at a predetermined temperature, for example 136°F. or 174°F., is interposed in the first conduit system 24 in conventional manner to detect the presence of heat in the vicinity of the combination alarm system 10. Thus, upon detecting the presence of temperature sufficiently elevated to activate the device, the fusible element 28 will melt to thereby open the first gas conduit system 24 to permit the flow of gas from within the cylinder 14 through the threaded fitting 18, through the first gas conduit system 24 and into the diaphragm horn 26 for alarm sounding purposes.

A second gas conduit system 30 connects to the side opening 22 of the fitting 18 and leads through the solenoid operated valve 32 to a second gas operated horn 34. The solenoid operated valve 32 is movable from a closed position wherein no gas can flow from the cylinder 14 through the second gas conduit system 30 to an open position wherein gas freely flows from the compressed gas cylinder 14 through the solenoid operated valve 32 to the second diaphragm horn 34 for alarm sounding purposes. The solenoid may be any suitable gas type solenoid valve such as the valve manufactured by Skinner Precision Industries, Inc., New Britain, Connecticut rated for 110 volt, 6 watt service.

A smoke detector 36 of approved design such as a photoelectric smoke detector or an ionization products of combustion detector is mounted within the cabinet 12 and has its sampling air inlets 38, 40 conveniently positioned to continuously sample the ambient air. Electrical energy to power the smoke detector may be supplied through a conventional electrical cord 39 which can be connected to a usual source (not shown) of 110v. electrical current in a well known manner. The smoke detector 36 should be of suitable type to close a relay or comparable device (not shown) to energize an electrical circuit 42 for solenoid valve 32 operation purposes as hereinafter more fully set forth. One detector that has been found suitable for this purpose is Model A1-711 as manufactured by Algenik Industries, Inc., Fort Lauderdale, Florida as listed and approved by Underwriters' Laboratories, Inc. This particular smoke detector 36 also includes a separate heat detector 44 and alarm sounding device 46 but these latter two features do not form a part of the present invention. See U.S. Pat. No. 3,383,670, for further details of this detector.

Upon detection of a predetermined density or concentration of smoke in the ambient atmosphere in accordance with recognized standards, such as the standards prepared by Underwriters' Laboratories, Inc. and the American Society for Testing and Materials, the smoke detector 36 will function to trigger a device such as a relay, semiconductor switch or similar device (not shown) which acts to energize the electrical circuit 42. The circuit 42 functions the solenoid operated valve 32 to thereby open the second gas conduit system 30 to expose the second horn 34 to the gaseous contents retained under pressure within the compressed gas cylinder 14. The passage of the gas (not shown) from the cylinder 14 through the second horn 34 activates the horn to thereby render the second horn directly responsive to the presence of smoke as detected by the smoke detector 36. Thus, it is seen that the first horn 26 is responsive to the presence of heat as controlled by the fusible element 38 and the second horn 34 is directly responsive to the presence of a concentration of smoke as controlled by the solenoid operated valve 32 upon function of the smoke detector 36.

It will be appreciated that the fitting 18 simultaneously pressurizes the first gas conduit system 24 and the second gas conduit system 30 by exposing both gas conduit systems to the gaseous contents of the compressed gas cylinder 14. In this manner, either the system 24 or the system 30 can be activated upon sensing respectively the presence of a sufficient concentration of smoke or of a predetermined elevated temperature. Should a fire develop and generate sufficient quantities of smoke and sufficient elevated temperatures to activate both the smoke detector 36 and the fusible element 28, then both horns 26, 34 will be simultaneously activated to thereby generate an alarm sound of much greater intensity than that possible from only a single sounding device. Thus, as a fire develops intensity, the single unit 10 is designed to greatly increase the alarm intensity capabilities.

For example, by employing the applicable Underwriters' Laboratories, Inc. test procedures, a single horn 26 was activated and a generated sound in the range of 115 dBa was noted. Then the second horn 34 was simultaneously activated and readings in the range of 118–120 dBa resulted. As set forth in a publication entitled "Household Fire Warning Equipment Spot Type Detectors," published by Fire Equipment Manufacturers Association (FEMA), May 1974, page 12, each increase of one decibel is equal to an effective increase in intensity of sound of 26 percent.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a combination smoke and heat detector alarm, the combination of

A. a self contained source of energy,
   1. said source including an energy outlet,
   2. said source being compressed gas;

B. a first conduit system communicating with the outlet,
   1. said first conduit system including a first sounding device, said first sounding device being a gas operated horn,
   2. said first conduit system including first valve means to regulate the flow of energy from the source to the first sounding device,
   3. said first valve means being movable by non-electrical energy from a closed condition to an open condition upon sensing a predetermined high temperature in the vicinity of the alarm; and C. a second conduit system communicating with the said outlet,
   1. said second conduit system including a second sounding device, said second sounding device being a gas operated horn, 2. said second conduit system including second valve means to regulate the flow of energy from the source to the second sounding device,
   3. said second valve means being movable by electrical energy from a closed position to an open position upon sensing a predetermined quantity of smoke in the vicinity of the alarm.

2. The alarm of claim 1 wherein there is no direct connection between the first sounding device and the second sounding device.

3. The alarm of claim 1 wherein the first valve means comprise a fusible element, said fusible element melting upon the presence of elevated temperatures to move the first valve means from the said closed condition to the open condition.

4. The alarm of claim 3 wherein the first valve means positions entirely within the first conduit system.

5. The alarm of claim 1 wherein the second valve means include an electrically powered smoke detector.

6. The alarm of claim 5 wherein the second valve means include a solenoid operated valve, said valve being normally closed to prevent the flow of compressed gas through the second conduit system, said valve being opened by the smoke detector upon detection of the predetermined concentration of smoke, said valve being positioned within the second conduit system.

7. The alarm of claim 6 and a fitting attached to the outlet, said fitting having a single inlet connection to receive compressed gas from the outlet, said fitting having a first connection to the first conduit system and a second connection to the second conduit system, the said first connection, second connection and the inlet connection being interiorly interconnected to simultaneously pressurize both the first and second conduit systems.

8. The alarm of claim 7 wherein the first and second conduit systems include means to simultaneously conduct energy to the first and second sounding devices whereby the horns can be operated simultaneously.

9. The alarm of claim 8 wherein the means to conduct energy to the first and second sounding devices include means to function the first and second valve means simultaneously.

10. The alarm of claim 8 wherein the means to conduct energy to the first and second sounding device include means to function the first and second valve means individually.

11. The alarm of claim 1 wherein one horn generates a sound of intensity in the range of 115 dBa and wherein the alarm includes means to increase the intensity of the sound by a range of approximately 78 percent to 130 percent.

12. The alarm of claim 11 wherein the means to increase include means to function the first and second sounding devices simultaneously.

* * * * *